US007775159B2

(12) United States Patent
Krauser et al.

(10) Patent No.: US 7,775,159 B2
(45) Date of Patent: Aug. 17, 2010

(54) CANTILEVERED BLANKET CYLINDER LIFTING MECHANISM

(75) Inventors: John Lindsey Krauser, Durango, CO (US); Brian Joseph Gentle, Rochester, NH (US); Bryan Charles Dustin, Strafford, NH (US)

(73) Assignee: Goss International Americas, Inc., Durham, NH (US)

( * ) Notice: Subject to any disclaimer, the term of this patent is extended or adjusted under 35 U.S.C. 154(b) by 757 days.

(21) Appl. No.: 11/388,609

(22) Filed: Mar. 24, 2006

(65) Prior Publication Data

US 2006/0219112 A1 Oct. 5, 2006

Related U.S. Application Data

(60) Provisional application No. 60/666,440, filed on Mar. 30, 2005.

(51) Int. Cl.
*B41F 13/24* (2006.01)
*B41F 7/02* (2006.01)

(52) U.S. Cl. ..... 101/247; 101/218

(58) Field of Classification Search ..... 101/218, 101/247, 137, 139, 140, 143, 144, 145, 184, 101/185
See application file for complete search history.

(56) References Cited

U.S. PATENT DOCUMENTS

| | | | | |
|---|---|---|---|---|
| 2,172,364 A | | 9/1939 | De Manna | 271/80 |
| 3,527,165 A | | 9/1970 | Harless | 101/143 |
| 3,800,698 A | * | 4/1974 | Kist et al. | 101/137 |
| 4,240,346 A | | 12/1980 | Landis et al. | 101/139 |
| 4,281,595 A | * | 8/1981 | Fujishiro | 101/177 |
| 4,442,773 A | * | 4/1984 | Kobayashi | 101/177 |
| 4,458,591 A | | 7/1984 | Guaraldi | 101/247 |
| 4,620,480 A | | 11/1986 | Hermach | 101/179 |
| 4,643,090 A | | 2/1987 | McKrell et al. | 101/218 |
| 4,677,911 A | | 7/1987 | Hermach | 101/218 |
| 4,807,527 A | | 2/1989 | Knauer | 101/216 |
| 4,815,377 A | * | 3/1989 | Skiera | 101/218 |
| 4,823,693 A | | 4/1989 | Koebler | 101/218 |
| 4,831,926 A | | 5/1989 | Bowman et al. | 101/138 |

(Continued)

FOREIGN PATENT DOCUMENTS

DE 2046131 3/1972

(Continued)

OTHER PUBLICATIONS

Mike Thompson, Sunday 2000—Auto Transfer "Zero Makeready Format" WOA Conference, Nashville, TN May 7, 2003, pp. 1-14.

(Continued)

*Primary Examiner*—Judy Nguyen
*Assistant Examiner*—Leo T Hinze
(74) *Attorney, Agent, or Firm*—Davidson, Davidson & Kappel, LLC

(57) ABSTRACT

An offset print unit includes a plate cylinder, a blanket cylinder having an end and a blanket gear coaxial with the blanket cylinder, a drive axle or pinion supporting a gear driving the blanket gear and a blanket lift arm for selectively supporting the end to cantilever the blanket cylinder, the blanket lift arm being rotatable about the drive axle or pinion. A method is also provided.

6 Claims, 8 Drawing Sheets

U.S. PATENT DOCUMENTS

| | | | | |
|---|---|---|---|---|
| 4,875,936 | A | 10/1989 | Hermach | 101/218 |
| 4,913,048 | A | 4/1990 | Tittgemeyer | 101/141 |
| 4,932,321 | A | 6/1990 | Hermach | 101/211 |
| 4,934,265 | A | 6/1990 | Knauer | 101/177 |
| 5,003,889 | A | 4/1991 | Glunz et al. | 101/228 |
| 5,005,475 | A | 4/1991 | Knauer | 101/218 |
| 5,042,788 | A | 8/1991 | Bowman et al. | 270/21.1 |
| RE33,944 | E | 6/1992 | Knauer | 101/216 |
| 5,161,463 | A | 11/1992 | Knauer et al. | 101/220 |
| 5,237,920 | A | 8/1993 | Guaraldi | 101/216 |
| 5,241,905 | A | 9/1993 | Guaraldi et al. | 101/216 |
| 5,245,923 | A | 9/1993 | Vrotacoe | 101/217 |
| 5,289,770 | A | 3/1994 | Hern | 101/226 |
| 5,301,609 | A | 4/1994 | Guaraldi et al. | 101/216 |
| 5,304,267 | A | 4/1994 | Vrotacoe | 156/86 |
| 5,316,798 | A | 5/1994 | Tittgemeyer | 427/409 |
| 5,323,702 | A | 6/1994 | Vrotacoe | 101/217 |
| 5,337,664 | A | 8/1994 | Hannon | 101/218 |
| 5,351,616 | A * | 10/1994 | Gelinas et al. | 101/218 |
| 5,394,797 | A | 3/1995 | Doebler et al. | 101/216 |
| 5,415,092 | A | 5/1995 | Hern | 101/226 |
| RE34,970 | E | 6/1995 | Tittgemeyer | 101/141 |
| 5,421,260 | A | 6/1995 | Doebler | 101/247 |
| 5,429,048 | A | 7/1995 | Gaffney et al. | 101/217 |
| 5,440,981 | A | 8/1995 | Vrotacoe et al. | 101/217 |
| 5,481,972 | A | 1/1996 | Schmid | 101/216 |
| 5,488,903 | A | 2/1996 | Koebler et al. | 101/375 |
| 5,492,062 | A | 2/1996 | Harris et al. | 101/486 |
| 5,505,127 | A | 4/1996 | Knauer | 101/218 |
| 5,522,316 | A | 6/1996 | Singler | 101/479 |
| 5,524,539 | A | 6/1996 | Doebler | 101/247 |
| 5,535,674 | A | 7/1996 | Vrotacoe et al. | 101/216 |
| 5,535,675 | A | 7/1996 | Gentle | 101/248 |
| 5,546,859 | A | 8/1996 | Hern | 101/226 |
| 5,553,541 | A | 9/1996 | Vrotacoe et al. | 101/217 |
| 5,560,292 | A | 10/1996 | Knauer | 101/216 |
| 5,595,115 | A | 1/1997 | Rau et al. | 101/142 |
| 5,651,314 | A | 7/1997 | Gentle | 101/248 |
| 5,653,428 | A | 8/1997 | Dufour et al. | 270/6 |
| 5,671,636 | A | 9/1997 | Gagne et al. | 74/409 |
| 5,678,485 | A | 10/1997 | Guaraldi | 101/247 |
| RE35,646 | E | 11/1997 | Guaraldi et al. | 101/216 |
| 5,683,202 | A | 11/1997 | Hummel et al. | 403/325 |
| 5,699,735 | A | 12/1997 | Stein et al. | 101/219 |
| 5,746,132 | A | 5/1998 | Parks et al. | 101/483 |
| 5,768,990 | A | 6/1998 | Vrotacoe et al. | 101/217 |
| 5,771,804 | A | 6/1998 | Knauer et al. | 101/183 |
| 5,782,182 | A | 7/1998 | Ruckmann et al. | 101/177 |
| 5,794,529 | A | 8/1998 | Dawley et al. | 101/216 |
| 5,802,975 | A | 9/1998 | Prem et al. | 101/375 |
| 5,813,336 | A | 9/1998 | Guaraldi et al. | 101/218 |
| 5,832,821 | A | 11/1998 | Petersen et al. | 101/216 |
| 5,894,796 | A | 4/1999 | Gelinas | 101/219 |
| 5,901,648 | A | 5/1999 | Roland et al. | 101/218 |
| 5,960,714 | A | 10/1999 | Goettling et al. | 101/216 |
| 5,970,870 | A | 10/1999 | Shiba et al. | 101/137 |
| 5,979,371 | A | 11/1999 | Lewis | 122/494 |
| 6,019,039 | A * | 2/2000 | Knauer et al. | 101/218 |
| 6,032,579 | A | 3/2000 | Richards | 101/219 |
| 6,038,975 | A | 3/2000 | Hoffmann et al. | 101/375 |
| 6,041,707 | A | 3/2000 | Petersen et al. | 101/232 |
| 6,050,185 | A | 4/2000 | Richards | 101/142 |
| 6,050,190 | A | 4/2000 | Knauer et al. | 101/216 |
| 6,053,105 | A | 4/2000 | Rudzewitz | 101/477 |
| 6,082,724 | A | 7/2000 | Kahlig et al. | 270/52.14 |
| 6,085,651 | A | 7/2000 | Defrance et al. | 101/247 |
| 6,093,139 | A | 7/2000 | Belanger | 493/353 |
| 6,109,180 | A | 8/2000 | Guaraldi et al. | 101/466 |
| 6,148,684 | A | 11/2000 | Gardiner | 74/440 |
| 6,175,775 | B1 | 1/2001 | Grunder | 700/111 |
| 6,186,064 | B1 | 2/2001 | Dufour | 101/181 |
| 6,205,926 | B1 | 3/2001 | Dufour | 101/492 |
| 6,216,592 | B1 | 4/2001 | Knauer et al. | 101/247 |
| 6,227,110 | B1 | 5/2001 | Zlatin | 101/218 |
| 6,227,111 | B1 | 5/2001 | Dawley et al. | 101/218 |
| 6,272,985 | B1 | 8/2001 | Keller et al. | 101/137 |
| 6,289,805 | B1 | 9/2001 | Douillard et al. | 101/247 |
| 6,343,547 | B1 | 2/2002 | Callahan et al. | 101/216 |
| 6,345,574 | B1 | 2/2002 | Charette et al. | 101/180 |
| 6,360,664 | B1 | 3/2002 | Goettling et al. | 101/481 |
| 6,374,731 | B1 | 4/2002 | Walczak et al. | 101/142 |
| 6,374,734 | B1 | 4/2002 | Gaffney et al. | 101/376 |
| 6,386,100 | B1 | 5/2002 | Gaffney et al. | 101/142 |
| 6,397,743 | B1 | 6/2002 | Dauer et al. | 101/220 |
| 6,397,751 | B1 | 6/2002 | Ramsay | 101/477 |
| 6,460,457 | B1 | 10/2002 | Ramsay | 101/477 |
| 6,494,135 | B1 | 12/2002 | Goettling et al. | 101/213 |
| 6,494,138 | B1 | 12/2002 | Goettling et al. | 101/479 |
| 6,520,083 | B2 | 2/2003 | Petersen et al. | 101/401.1 |
| 6,526,888 | B2 | 3/2003 | Douillard et al. | 101/484 |
| 6,543,352 | B1 | 4/2003 | Dilling et al. | 101/220 |
| 6,553,908 | B1 | 4/2003 | Richards et al. | 101/248 |
| 6,557,467 | B1 | 5/2003 | Dilling et al. | 101/220 |
| 6,615,726 | B2 | 9/2003 | Douillard et al. | 101/483 |
| 6,647,876 | B2 | 11/2003 | Emery et al. | 101/247 |
| 6,739,251 | B2 | 5/2004 | Gaffney et al. | 101/217 |
| 6,820,547 | B2 | 11/2004 | Fujiwara | 101/218 |
| 6,937,751 | B2 | 8/2005 | Ritt et al. | 382/132 |
| 6,966,258 | B2 | 11/2005 | Charette et al. | 101/180 |
| 6,986,305 | B2 | 1/2006 | Knauer | 101/220 |
| 7,011,022 | B2 * | 3/2006 | Motard et al. | 101/217 |
| 7,032,510 | B2 | 4/2006 | Christel et al. | 101/216 |
| 7,156,018 | B2 * | 1/2007 | Holm et al. | 101/218 |
| 2002/0033105 | A1 | 3/2002 | Charette et al. | 101/220 |
| 2002/0078840 | A1 | 6/2002 | Gaffney et al. | 101/217 |
| 2004/0083911 | A1 | 5/2004 | Fujiwara | 101/247 |
| 2004/0206257 | A1 | 10/2004 | Gaffney et al. | 101/217 |
| 2004/0237817 | A1 | 12/2004 | Rauh | 101/218 |
| 2005/0160928 | A1 * | 7/2005 | Motard et al. | 101/217 |
| 2005/0160933 | A1 | 7/2005 | Ruschkowski | 101/425 |

FOREIGN PATENT DOCUMENTS

| | | | |
|---|---|---|---|
| DE | 3543704 | A1 | 6/1987 |
| DE | 3716188 | A1 | 12/1987 |
| DE | 4138479 | A1 | 6/1993 |
| DE | 4337554 | A1 | 6/1994 |
| DE | 4412873 | A1 | 11/1994 |
| DE | 9018111 | U | 6/1995 |
| DE | 4408025 | A1 | 9/1995 |
| DE | 4435429 | A1 | 4/1996 |
| DE | 19501243 | A1 | 7/1996 |
| DE | 4143597 | C2 | 6/1998 |
| DE | 19903847 | A1 | 8/2000 |
| DE | 19919272 | A1 | 11/2000 |
| DE | 10013979 | A1 | 12/2000 |
| DE | 10008936 | A1 | 8/2001 |
| EP | 0225509 | A2 | 6/1987 |
| EP | 0388740 | B1 | 9/1990 |
| EP | 0421145 | B2 | 4/1991 |
| EP | 0549936 | A1 | 7/1993 |
| EP | 0581019 | B1 | 2/1994 |
| EP | 0596244 | A1 | 5/1994 |
| EP | 0644048 | A2 | 3/1995 |
| EP | 0683043 | B1 | 11/1995 |
| EP | 0685335 | B1 | 12/1995 |
| EP | 0697284 | B1 | 2/1996 |
| EP | 0741015 | B1 | 11/1996 |
| EP | 0749927 | B1 | 12/1996 |
| EP | 0782920 | B1 | 7/1997 |
| EP | 0813958 | B1 | 12/1997 |
| EP | 0813959 | B1 | 12/1997 |
| EP | 0845352 | A1 | 6/1998 |
| EP | 0862999 | B1 | 9/1998 |

| | | | |
|---|---|---|---|
| EP | 0956951 | B1 | 11/1999 |
| EP | 0958917 | B1 | 11/1999 |
| EP | 0995595 | B1 | 4/2000 |
| EP | 1075943 | A1 | 2/2001 |
| EP | 1075944 | B1 | 2/2001 |
| EP | 1075945 | A1 | 2/2001 |
| EP | 1132202 | B1 | 9/2001 |
| EP | 1155825 | A2 | 11/2001 |
| EP | 1167028 | A2 | 1/2002 |
| FR | 2787059 | | 6/2000 |
| GB | 2149149 | A | 6/1985 |
| GB | 2 273 464 | | 6/1995 |
| GB | 2309668 | A | 8/1997 |
| JP | 63-236651 | | 10/1988 |
| WO | WO 03/000496 | A1 | 1/2003 |
| WO | WO 03/084757 | A1 | 10/2003 |

OTHER PUBLICATIONS

Harris Corporation, The Harris M-112 and M-122: Profits through Automation, pp. 1-4.

Jochen Pagenberg; Johannes Lang, Le Droit Allemand Des Brevets Et Des Modeles D'Utilite, 1997.

Von Marcel Jacomet, Regeln und Steuern mit unscharfer Logik; pp. 94+, 1992.

Goss Sunday 2000 Automatic Transfer Provides Exclusive Zero-Makeready Advantages, Oct. 18, 2004 www.members.what-theythink.com/allsearch/article.cfm?id=17971&printer=pr.

Goss bietet Null-Rustzeiten-Vorteil, Oct. 2004, www.druckspiegel.de/archiv/news/2004/10/news.html.

Goss Sunday 2000 Automatic Transfer provides exclusive zero-makeready advantages, Oct. 10, 2004 www.gossinternational.com/index.php?src=news&prid=21&category=Commerical... .

Heidelberg Introduces Web Offset Makeready Breakthrough, Feb. 6, 2004, pp. 1-3.

Web Offset, Issue No. 55, pp. 1-16, Published by Goss International Corporation 2004.

Rotoman S Printing Unit, 2005. www.man-roland.de/en/popups/pw0118/w0011/index.jsp.

* cited by examiner

CANTILEVERED BLANKET CYLINDER LIFTING MECHANISM

This application claims priority to U.S. Provisional Application No. 60/666,440 filed Mar. 30, 2005, and hereby incorporated by reference herein.

BACKGROUND

The present invention relates generally to printing presses and more specifically to web offset printing presses having separable blankets.

U.S. Pat. No. 4,240,346 describes for example a printing press with two blanket cylinders separable from each other to permit a blanket throw off. In such presses, the blankets are offset from a vertical from each other, and in order to pass the web through the blankets when the blankets are offset, lead rolls or air bars are necessary to properly guide the web through the blankets. These guides can mark the printed product and also alter registration of the web between two printing print units, causing deteriorated print quality.

U.S. Pat. No. 6,343,547 describes a device to counterpoise a cylinder and a method for counterpoising a cylinder to be cantilevered on a printing press. U.S. Pat. No. 6,877,424 describes a counterpoise device for cantilevering at least one cylinder of a printing press having a movable counterpoise element for selectively contacting the cylinder and a stationary mount.

U.S. Pat. Nos. 6,216,592 and 6,019,039 describe printing units with throw-off mechanisms and are hereby incorporated by reference herein.

SUMMARY OF THE INVENTION

In a print unit in which blankets cylinders have a large displacement from on impression to off impression, interference between the optimal lifting arm pivot point and drive pinion locations may occur. Deviations from the optimal lifting arm pivot point cause increasingly difficult design of the lifting arm to accommodate lift loads.

By providing a blanket lift arm that resides independently around a rotating drive pinion, the lift arm pivot and drive pinion may occupy the same center while working independently of one another.

The present invention provides an offset print unit comprising:

a plate cylinder;

a blanket cylinder having an end and a blanket gear coaxial with the blanket cylinder;

a drive axle or pinion supporting a gear driving the blanket gear; and a blanket lift arm for selectively supporting the end to cantilever the blanket cylinder, the blanket lift arm being rotatable about the drive axle or pinion.

The present invention also provides a method for cantilevering a blanket cylinder driven by an axle or pinion offset from the blanket cylinder and having an axis parallel to an axis of the blanket cylinder, the method comprising:

rotating a blanket lift arm about the axis of the axle or pinion to contact an end of the blanket cylinder.

BRIEF DESCRIPTION OF THE DRAWINGS

Preferred embodiments of the present invention will be elucidated with reference to the drawings, in which.

DETAILED DESCRIPTION

Figure 1:
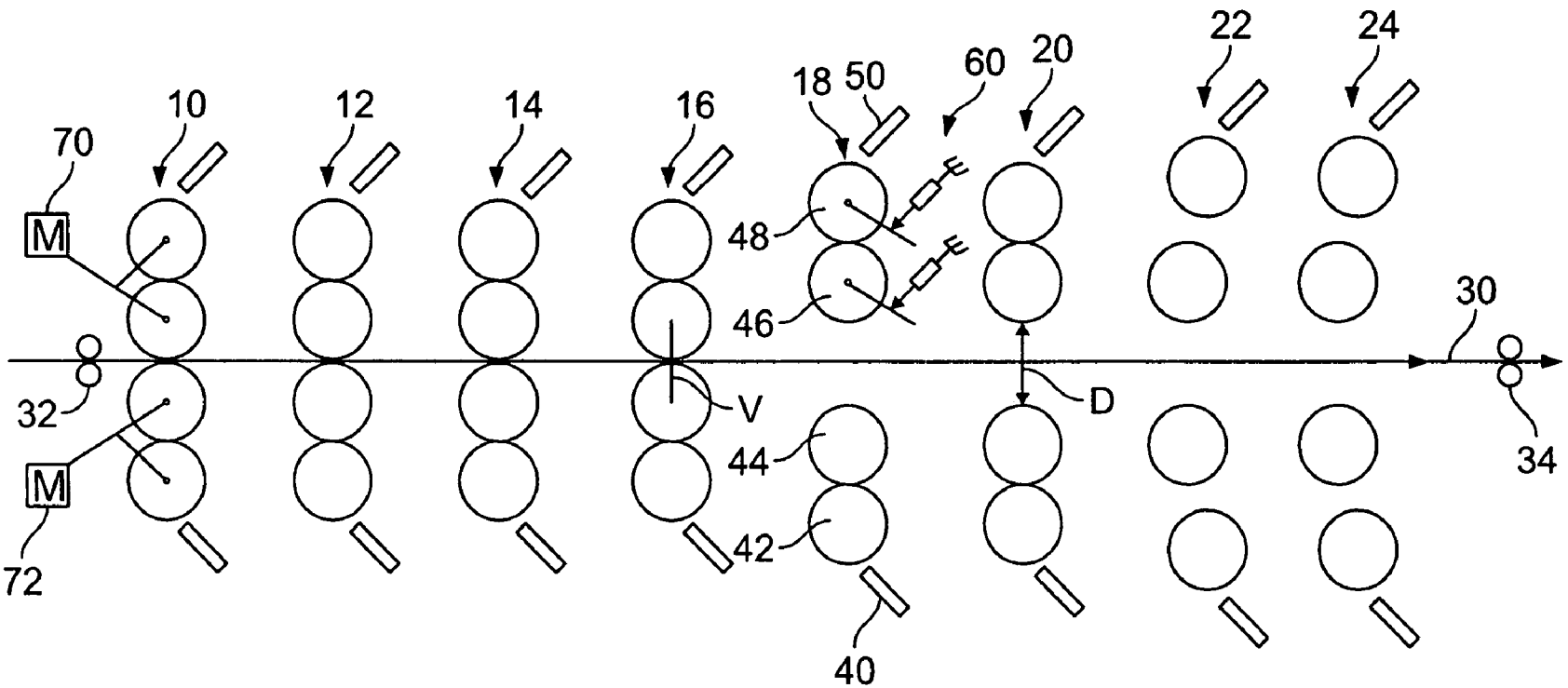
FIG. 1 shows a web offset printing press.

FIG. 1 shows a web offset printing press having eight offset print units 10, 12, 14, 16, 18, 20, 22, 24, each having a plate cylinder 42, blanket cylinder 44, plate cylinder 48 and blanket cylinder 46. Blanket cylinders 44 and 46 nip a web 30 in a printing mode, as shown for print units 10, 12, 14, 16, which may print black, cyan, yellow and magenta, respectively for example. The web may enter the print units via nip rollers 32 (which may be infeed rollers for example) and may exit via exit rollers 34, which may for example be located downstream of a dryer.

The blanket cylinders 44, 46 for each print unit may be thrown-off, as shown for units 22 and 24, so as to separate from each other and from the respective plate cylinder 42, 48. Plate cylinders 42, 48 may move back into contact with the blanket cylinders 44, 46, respectively, during an automatic plate change operation, for example via automatic plate changers 40 and 50, respectively. Automatic plate changers are described in U.S. Pat. Nos. 6,053,105, 6,460,457 and 6,397,751 and are hereby incorporated by reference herein.

A throw-off mechanism 60 is shown schematically for moving the blanket and plate cylinders 46, 48. Blanket cylinder 44 and plate cylinder 42 may have a similar throw-off mechanism. Preferably, each print unit is driven by two motors 70, 72, one driving one of the plate or blanket cylinders 46, 48, and one driving one of the plate cylinder 42 and blanket cylinder 44. The non-driven cylinder may be geared to the driven cylinder on each side of web 30. Each print unit 10, 12 . . . 24 may be the same.

The web path length between the nip rollers 32, 34 advantageously need not change, even when one of the print units has blanket cylinders which are thrown off. Registration may be unaffected by the throw-off. In addition, no web deflectors or stabilizers are needed, such as lead rolls or air rolls to make sure the web does not contact the blanket cylinders 44, 46, which could cause marking.

The throw-off distance D preferably is at least 0.5 inches and most preferably at least 1 inch, i.e. that the web has half an inch clearance on either side of the web. Moreover, the centers of the blanket cylinders 44, 46 preferably are in a nearly vertical plane V, which is preferably 10 degrees or less from perfect vertical. This has the advantage that the throw-off provides the maximum clearance for a horizontally traveling web.

The circumference of the plate cylinder preferably is less than 630 mm, and most preferably is 578 mm.

Figure 2:
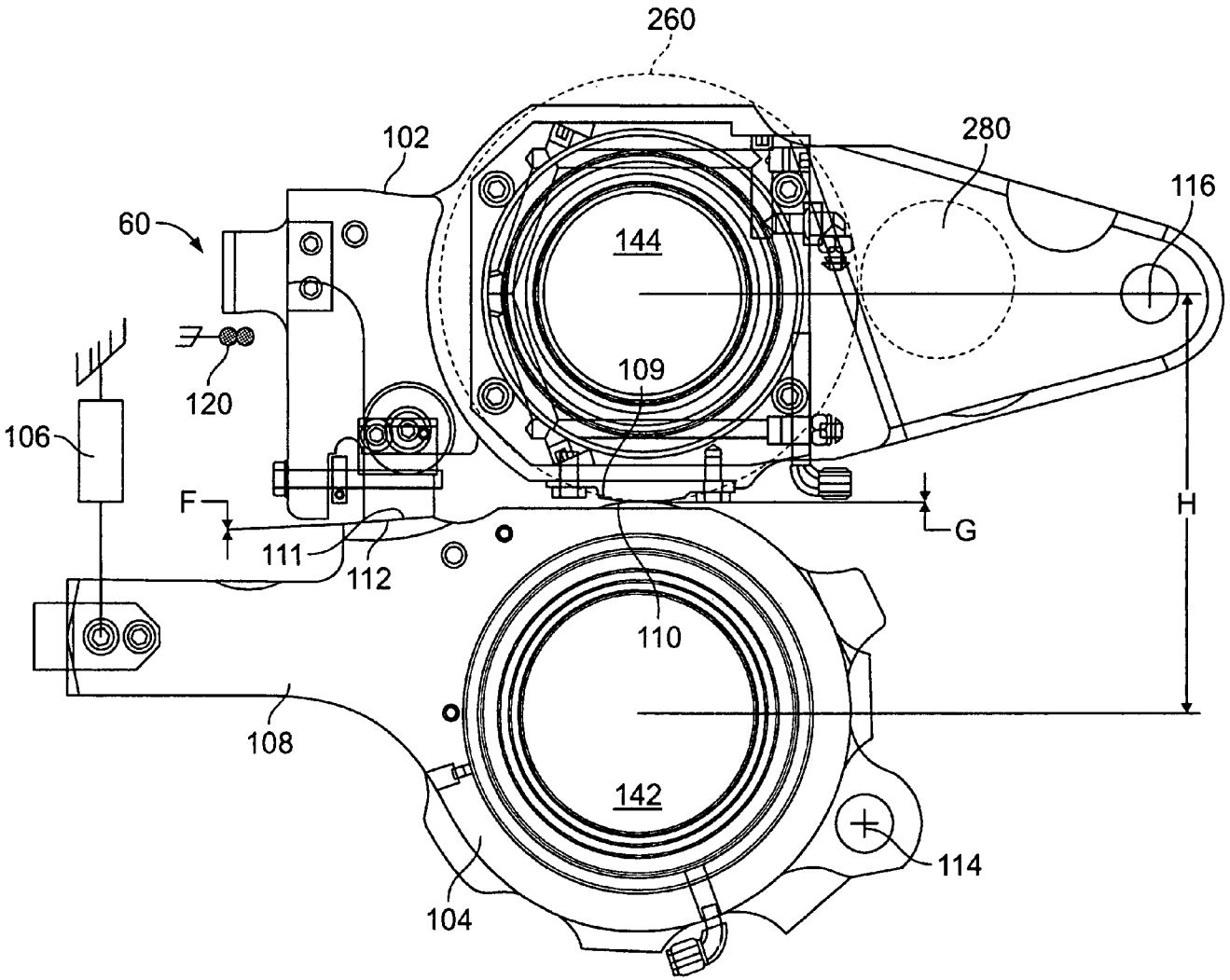
FIG. 2 shows bearer cams in a first printing position.

The creation of the large throw-off distance D is explained with an exemplary embodiment as follows:

FIG. 2 shows the throw-off mechanism 60 for the lower blanket 44. A blanket cylinder support 102 supports a gear side axle 144 of the blanket cylinder 44 and a plate cylinder support 104 supports a gear side axle 142 of the plate cylinder 42. The blanket cylinder support 102 is pivotable about an axis 116, and the plate cylinder support about an axis 114. A pneumatic cylinder 106 can move the plate cylinder support 104 via an arm 108.

When blanket cylinder 44 is in contact with blanket cylinder 46 in a printing position, a first bearer surface 111 of support 102 is in contact with a second bearer surface 112 of support 104, which another bearer surface 109 of the support 102 is not in contact with a bearer surface 110 of support 104. Distance F thus is zero, while a distance G between surfaces 109 and 110 may be 0.0045 inches. Distance H between the axial centers of the axles 144 and 142 may be 7.2463 inches.

Figure 3:
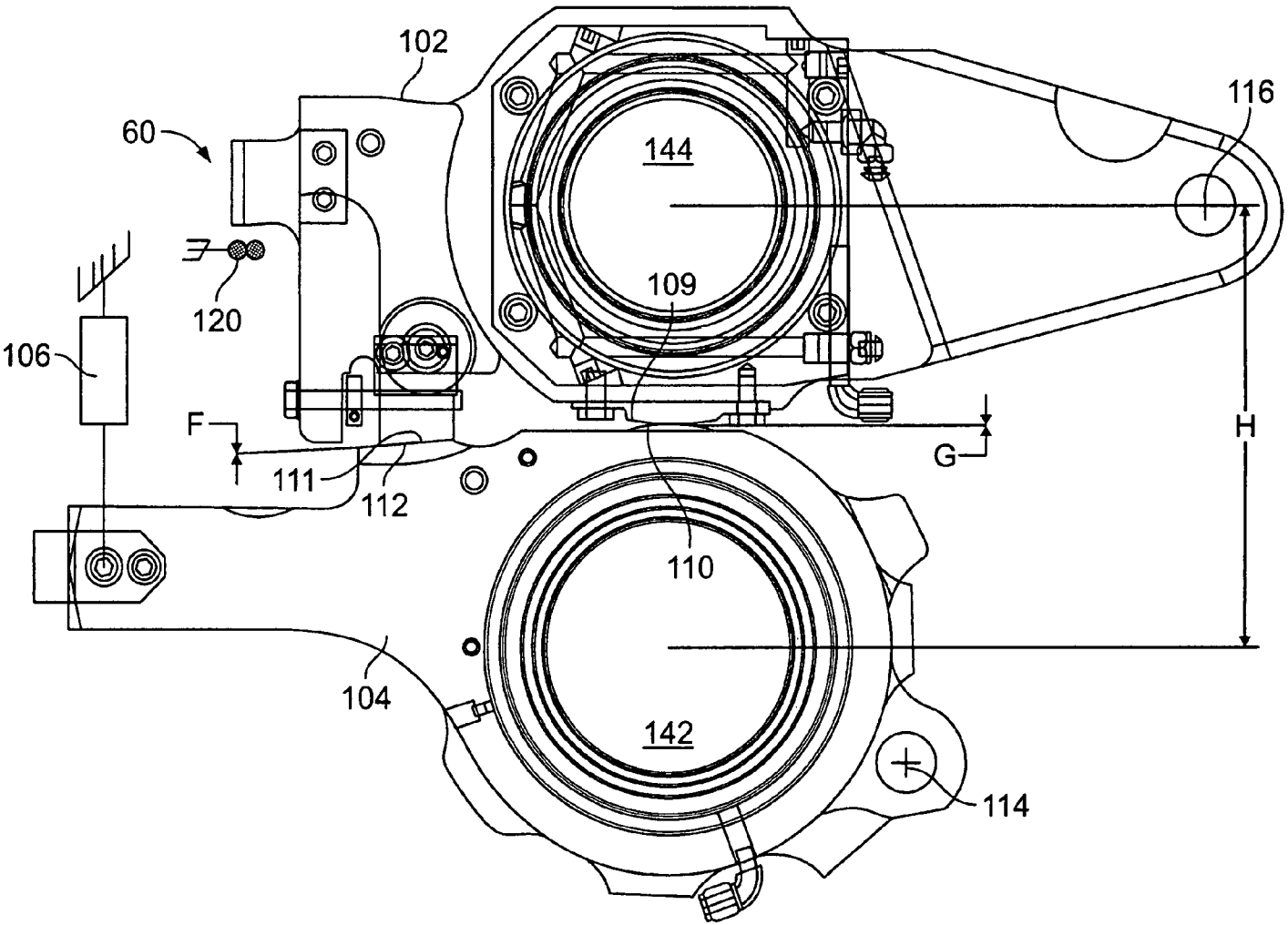
FIG. 3 shows bearer cams in a transition position.

In FIG. 3, support 104 is moved downwardly so distance H may be for example 7.2416 inches, and the distances F and G both are zero. The cam surfaces 111, 112 and 109, 110 thus are transitioning the load between themselves.

Figure 4:
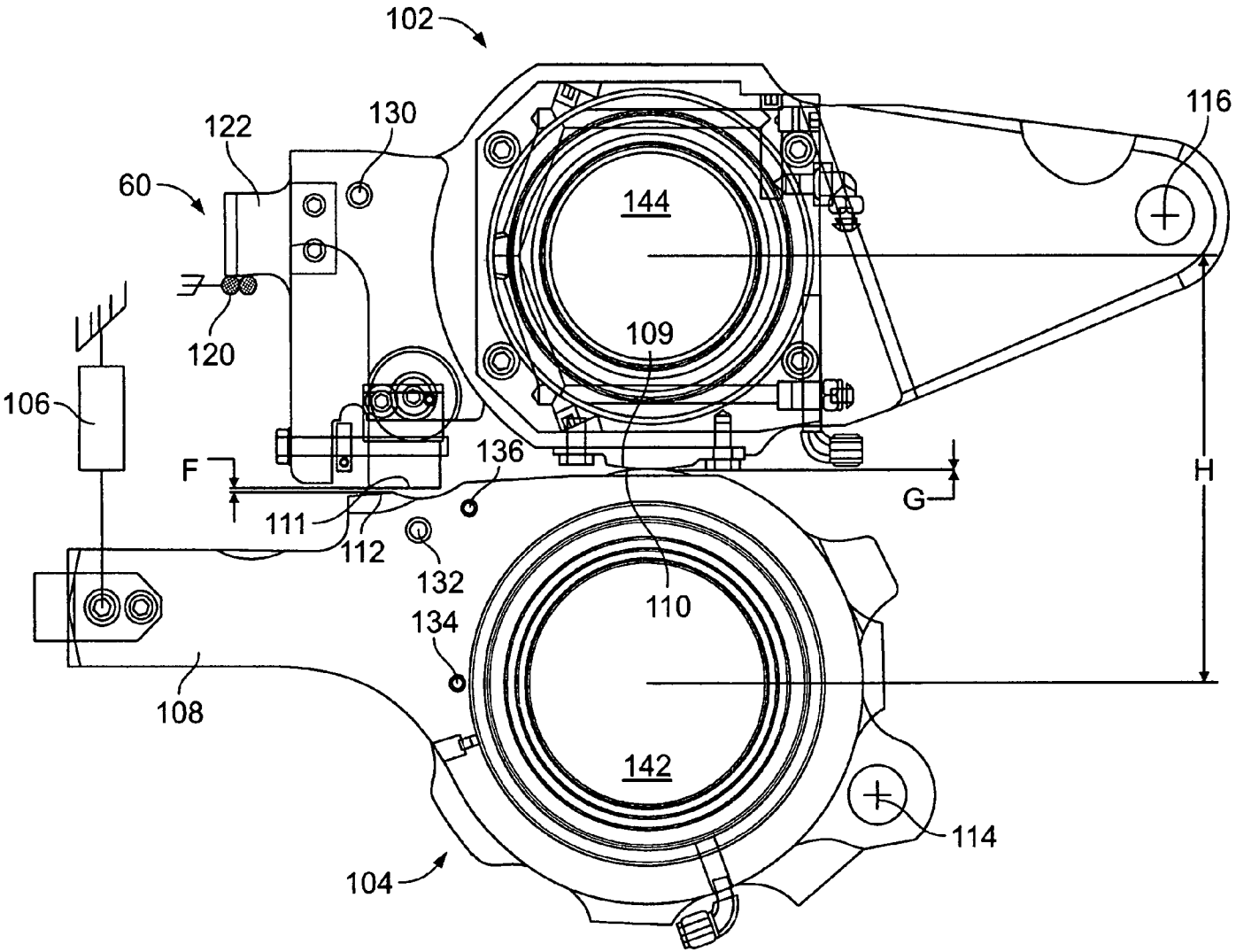
FIG. 4 shows bearer cams in a first throw-off position with the plate and blanket cylinders in contact.

As shown in FIG. 4, when support 104 moves downwardly more, blanket cylinder 44 is thrown-off the blanket cylinder 46, bearer surface or cam 109 of support 102 contacts bearer surface 110 of the box 104 so that the blanket cylinder box 102 rests on the box 104 at surfaces 109/110. A distance between the bearer surface 111 of box 102 and a bearer surface 112 of box 104 may be 0.1561 inches. The bearer surface 109 may have a same arc of curvature as blanket cylinder 44, and bearer surface 110 may have a same arc of curvature as plate cylinder 42, so that even in FIG. 4 distance H still remains 7.2416 inches. At this point an extension 122 also just comes into contact with a fixed stop 120 on a frame.

Figure 5:
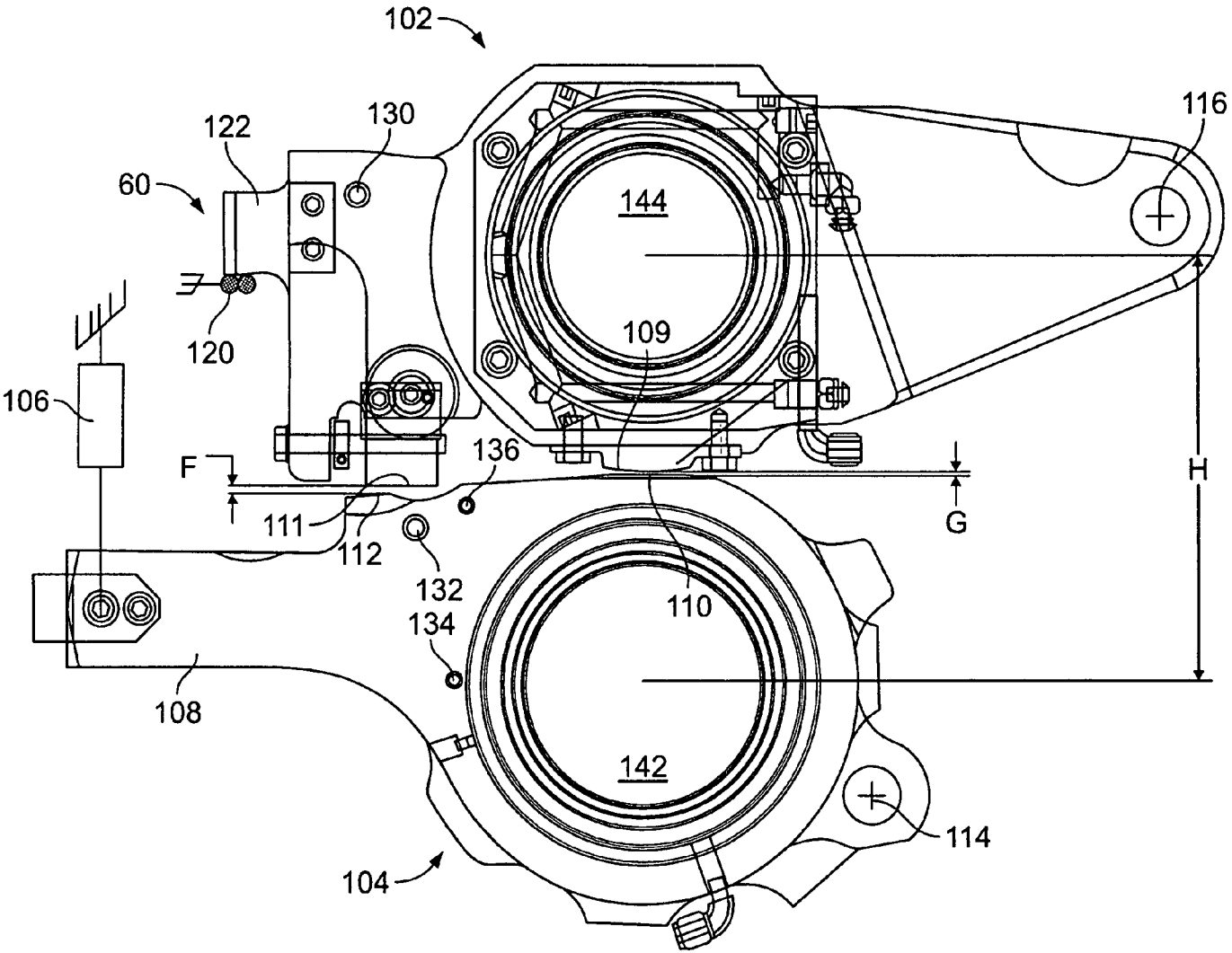
FIG. 5 shows bearer cams in a second throw-off position with the plate and blanket cylinders out of contact.

As shown in FIG. 5, when support 104 is moved downwardly more, blanket support 102 rests on stop 120 while plate support 104 moves downwardly even more. Thus, distance G between bearer surfaces 109 and 110 increases and may be 1 mm, for example. Distance F also increases. In this position, access to plate cylinder 42 for removing or changing a plate may be possible. For autoplating, the plate cylinder 42 may be moved again against the blanket cylinder 44 as in FIG. 4, if the autoplating mechanism so requires.

The upper plate and blanket throw-off mechanism may move in a similar manner with dual bearer surfaces, but since the gravity effects differ, a link may be provided between holes 130, 132 so that the raising of the plate cylinder 48 also causes the blanket cylinder 46 to rise.

As shown in FIG. 2, a drive gear 280 may drive a blanket cylinder gear 260. The blanket cylinder gear 260 may drive a similar plate cylinder gear. These gears 280, 260 may be axially inside the support 102, i.e. into the page. Due to the tangential arrangement of the gears, the rotation of the support 102 does not cause the gear 260 to disengage from gear 280 (which has an axis which does not translate). In the FIGS. 2, 3, 4, and 5 positions, the blanket cylinder gear 260 and an interacting plate cylinder gear can be driven by gear 280. The motor 72 thus can be used for auto-plating.

Figure 6:
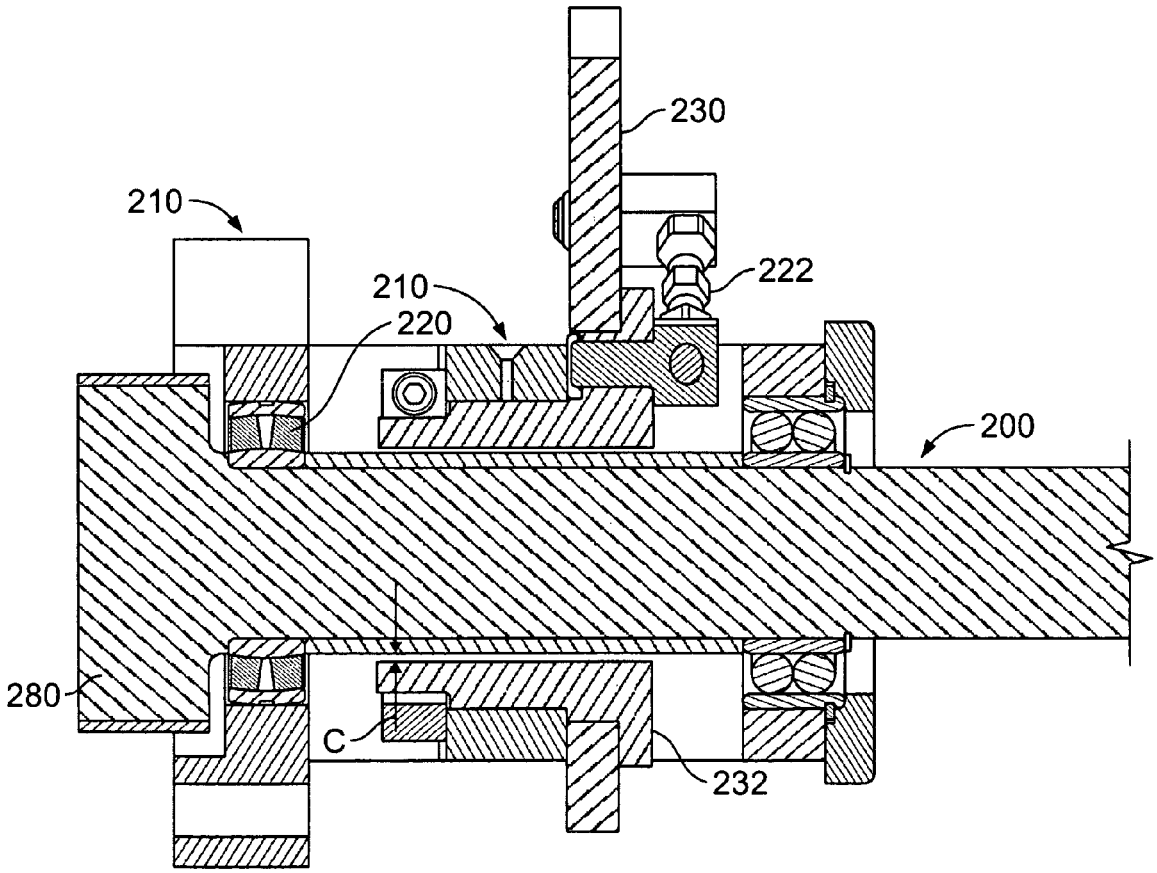
FIGS. 6, 7 and 8 show the drive pinion and cantilever lift mechanism for the blanket cylinder.
Figure 7:
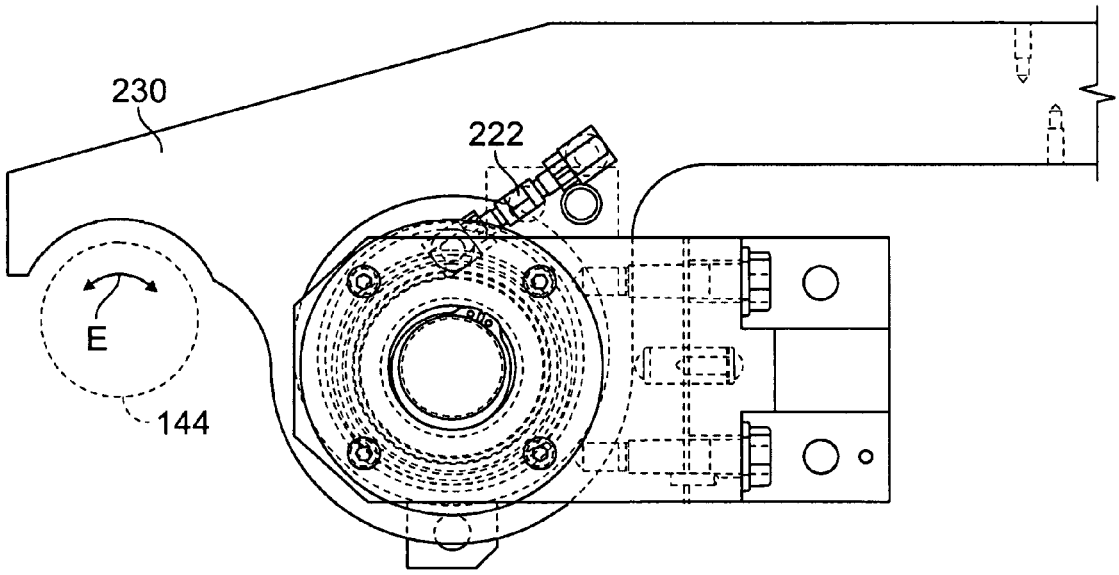
Figure 8:
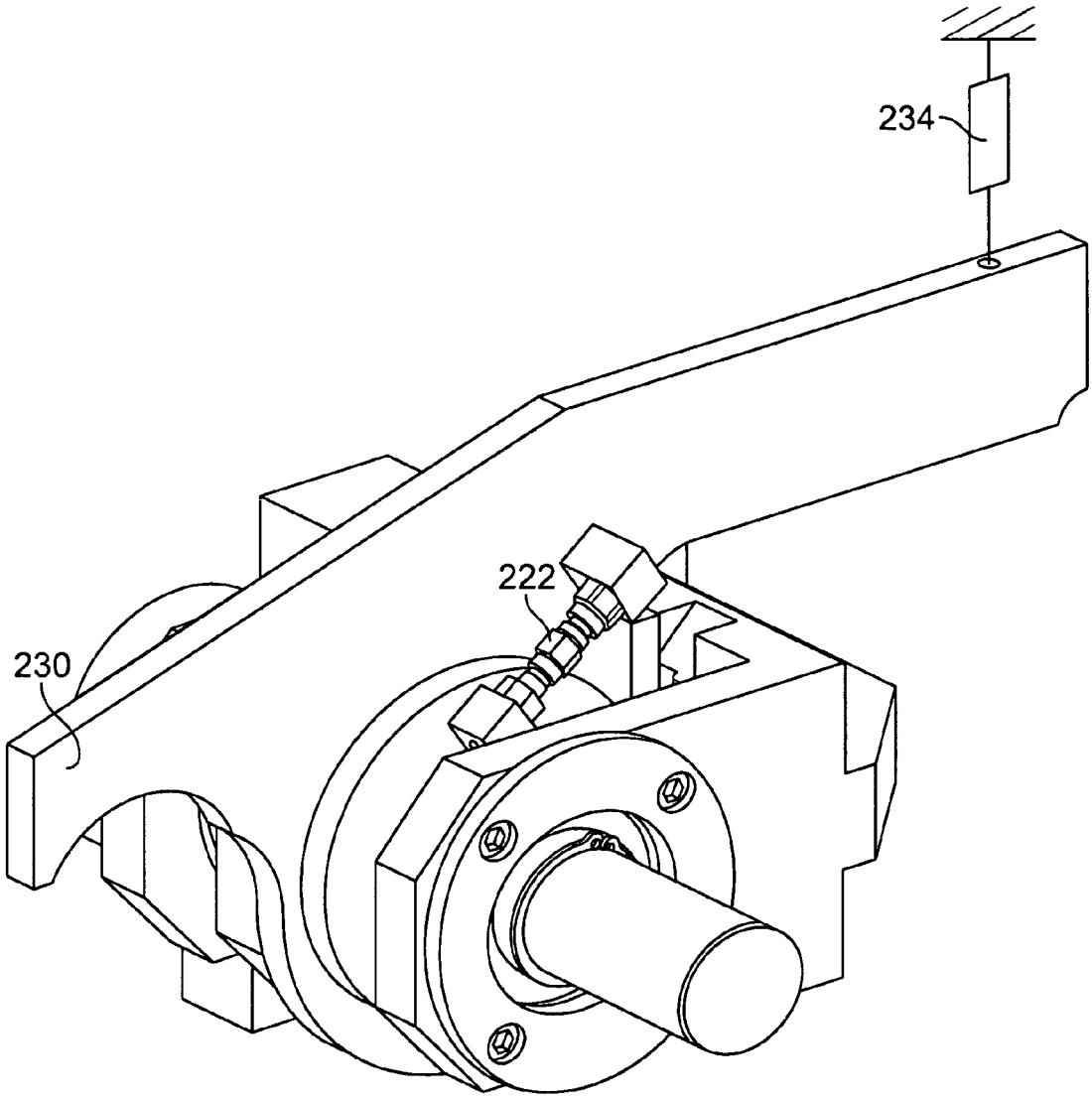

FIGS. 6, 7 and 8 show the drive pinion 200 driven by the motor 72 (FIG. 1), and connected to gear 280 which interacts with the blanket gear 260. A mounting bracket 210 supports the pinion 200 via bearings 220. A lifting arm 230 is supported for rotation around the pinion 200 and may be pneumatically actuated via a pneumatic cylinder 234 to interact with an end of the blanket cylinder 44 to permit removal axially of a sleeve-shaped blanket. Each blanket cylinder for each print unit preferably has a sleeve-shaped axially-removable blanket.

An adjusting screw 222 connects the lifting arm 230 to a lift arm eccentric 232, which has a circular inner surface a distance C from the drive pinion 200 and an eccentric outer surface. By adjusting the screw 222, the location for the lift arm 230 to support the blanket cylinder 44 may be adjusted in direction E.

By having the lifting arm 230 coaxial with the drive pinion 200, larger movements of the blanket cylinder 44 during throw-off may be accommodated.

The present invention thus provides for large movement of the blanket and plate cylinders while maintaining cantilevering for blanket sleeves and auto-plating capability.

What is claimed is:

1. An offset print unit comprising:

a plate cylinder;

a blanket cylinder having an end and a blanket gear coaxial with the blanket cylinder;

a drive axle or pinion supporting a gear driving the blanket gear; and a blanket lift arm for selectively supporting the end to cantilever the blanket cylinder, the blanket lift arm being rotatable about the drive axle or pinion, a contact point between the blanket lift arm and the end for cantilevering being adjustable.

2. The offset print unit as recited in claim 1 wherein the blanket lift arm includes an eccentric surrounding the drive axle or pinion.

3. An offset print unit comprising:

a plate cylinder;

a blanket cylinder having an end and a blanket gear coaxial with the blanket cylinder;

a drive axle or pinion supporting a gear driving the blanket gear; and a blanket lift arm for selectively supporting the end to cantilever the blanket cylinder, the blanket lift arm being rotatable about the drive axle or pinion; and an adjusting screw for adjusting a cantilevering position of the blanket lift arm.

4. The offset print unit as recited in claim 3 wherein the blanket lift arm includes an eccentric surrounding the drive axle or pinion.

5. A method for cantilevering a blanket cylinder driven by an axle or pinion offset from the blanket cylinder and having an axis parallel to an axis of the blanket cylinder, the method comprising:

rotating a blanket lift arm about the axis of the axle or pinion to contact an end of the blanket cylinder to cantilever the blanket cylinder for mounting or removing a sleeve-shaped, axially-removable blanket thereon; and adjusting a cantilevering position of the blanket lift arm.

6. The method as recited in claim 5 wherein adjusting the blanket arm includes using an adjusting screw.

* * * * *